United States Patent [19]

Saferstein et al.

[11] Patent Number: 4,671,303

[45] Date of Patent: Jun. 9, 1987

[54] NIT COMB AND METHOD OF PRODUCING SAME

[76] Inventors: Albert Saferstein; Gilbert Spector, both of 480 W. Putnam Ave., Greenwich, Conn. 06830

[21] Appl. No.: 797,761

[22] Filed: Nov. 13, 1985

Related U.S. Application Data

[63] Continuation of Ser. No. 711,341, Mar. 13, 1985, abandoned, which is a continuation of Ser. No. 516,169, Jul. 21, 1983, abandoned, which is a continuation of Ser. No. 265,047, May 19, 1981, abandoned.

[51] Int. Cl.[4] ..... A45D 24/04

[52] U.S. Cl. ..... 132/11 R; 132/152; 119/86

[58] Field of Search ..... 132/11 R, 106, 107, 132/138, 152, 155, 157; 119/83, 86, 92

[56] References Cited

U.S. PATENT DOCUMENTS

| | | | |
|---|---|---|---|
| 928,785 | 7/1909 | McLean | 132/152 |
| 1,559,055 | 10/1925 | Smith | 132/155 X |
| 3,665,937 | 5/1972 | Nakagawa et al. | 132/11 R |

*Primary Examiner*—Robert P. Swiatek

*Attorney, Agent, or Firm*—Sprung Horn Kramer & Woods

[57] ABSTRACT

A nit comb and method of producing same wherein a plurality of metal teeth are formed with a minimum intertooth clearance of about 100 microns and mounted in a handle.

2 Claims, 9 Drawing Figures

NIT COMB AND METHOD OF PRODUCING SAME

This application is a continuation of application Ser. No. 711,341, filed Mar. 13, 1985, now abandoned, which is a continuation of application Ser. No. 516,169, filed July 21, 1983, now abandoned and which is a continuation of Ser. No. 265,047, filed May 19, 1981, now abandoned.

BACKGROUND OF THE INVENTION

The present invention relates to a nit comb and a method of producing same. More specifically, the invention relates to a nit comb having a handle and a plurality of metal teeth extending from the handle.

Metal tooth combs in general and nit combs in particular are known in the art. Nit combs are used to remove nits from the hair of a person or animal, nits being an accepted term for the eggs of body lice and the like.

While nit combs are known, these conventional combs have the disadvantage of not being able to reliably remove all of the nits from the hair of a person or animal. The missing of a single nit in the hair, will result in a secondary infestation of lice on that person. Thus there is and has been a tremendous need to effect a reliable as possible removal of nits from the hair.

While it has been desirable to achieve a close spacing of the teeth of the nit comb so as to remove the nits more reliably, this has not been possible with plastic combs due to the inherent limitations in known manufacturing processes thereof. Moreover, metal combs, while theoretically able to achieve close spacing of the teeth, require expensive and complex machining based on those techniques already known in the art.

Further, it is well recognized to those skilled in the art of hair treatment, that the close spacing of teeth of a comb would result in the snagging or catching of the hair in the comb thus not making it possible to run the comb through the hair to remove the nits.

SUMMARY OF THE INVENTION

The main object of the present invention is to provide a comb and a method of producing same which eliminate the disadvantages of the prior art.

Another object of the present invention is to provide a comb and a method of making same wherein the comb teeth are closely spaced so as to effect a reliable removal of nits from the hair, wherein the comb can easily slide through the hair without snagging.

These and other objects of the present invention are achieved according to the present invention by a nit comb comprising a handle and means forming a plurality of metal teeth having a minimum intertooth clearance of about 100 microns.

It has been surprisingly found that metal teeth having a minimum intertooth clearance of about 100 microns and preferably wherein the teeth are elongated and have a polished smooth substantial longitudinal extent with an intertooth clearance in the range of from about 100 to 120 microns, easily glides through the hair while reliably removing nits from the hair.

The minimum intertooth clearance and the intertooth clearance range according to the present invention is preferably obtained by a plurality of individual discrete metal tooth members, each having a mounting portion and a time portion extending therefrom, means fixedly interconnecting the tooth members at the mounting portions thereof with the minimum spacing between the tine portions and means fixedly mounting the interconnected members in the handle with only the tine portions projecting from the handle and defining the comb teeth.

In one embodiment of the invention the tine portion of the teeth are straight and in a preferred embodiment the tine portions of the teeth are arcuate so as to form a concave nit trap.

The means interconnecting the mounting portions of the tooth members can be a mechanical linking or a mechanical bonding by means of solder and epoxy resin.

The method according to the present invention comprises forming a plurality of metal teeth with a minimum intertooth spacing of about 100 microns and mounting the teeth in a handle. The mounting of the teeth in the handle is preferably carried out after the plurality of individual discrete metal tooth members are fixedly interconnected at the mounting portions thereof and the interconnected tooth members are preferably mounted in the handle by molding the handle out of plastic around the mounting portions of the tooth members.

Other features and advantages of the present invention will become more apparant from the following detailed description of the invention along with the accompanying drawings wherein:

DETAILED DESCRIPTION OF THE PREFERRED EMBODIMENTS

Figure 1:
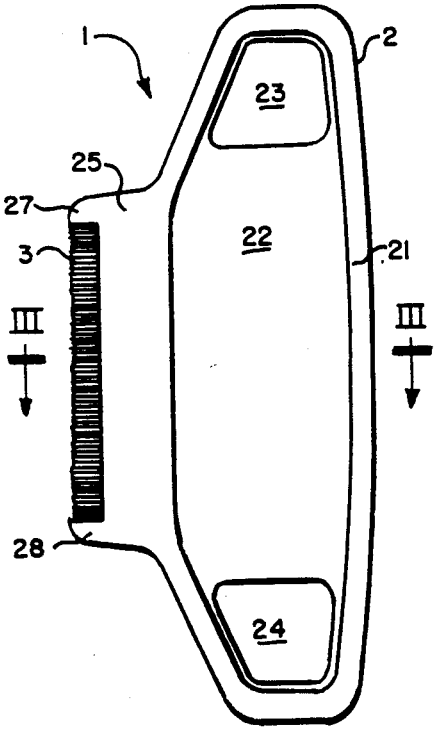
FIG. 1 is a top view of the nit comb according to the present invention.
Figure 2:
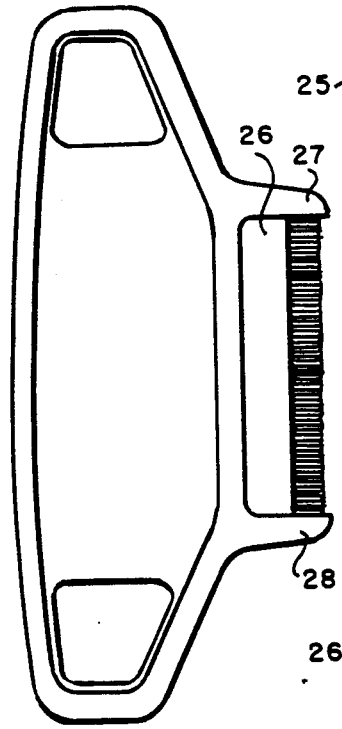
FIG. 2 is a bottom view of the comb of FIG. 1.
Figure 3:
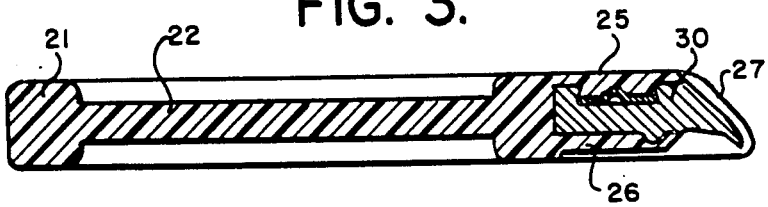
FIG. 3 is a sectional view along the line III—III of FIG. 1.

Referring to FIGS. 1–3, the nit comb 1 according to the present invention includes a handle 2 and means 3 forming metal teeth.

The handle 2 is preferably made of a rigid plastic such as ABS, and is preferably 4¾" in length, approximately 2" in width and approximately ¼" maximum thickness. At the periphery thereof, there is a relatively thick ribbed portion 21 surrounding a relatively thin central portion 22, preferably having a thickness of approximately 3/32". In the reduced thickness portion 22, are fingerholes 23, 24 which facilitate the gripping of the comb during use.

The comb handle according to the embodiment of FIGS. 1–3 is uniquely designed to be used ambidextrously, that is by either hand with equal facility. The comb is symmetrical about the section line III—III in FIG. 1.

Figure 4:
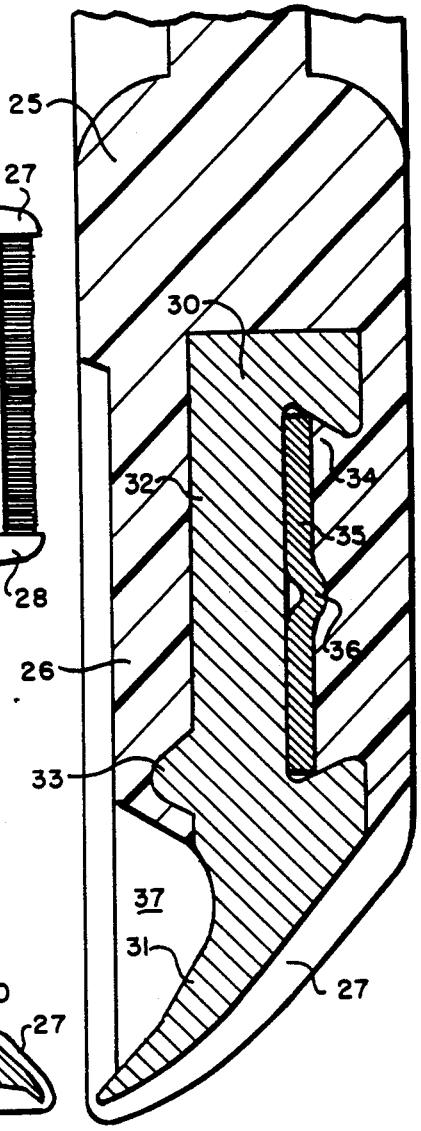
FIG. 4 is a detail of the sectional view of FIG. 3.
Figure 5:
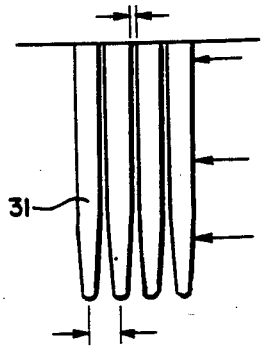
FIG. 5 is a detail of the comb teeth according to the present invention.
Figure 6:
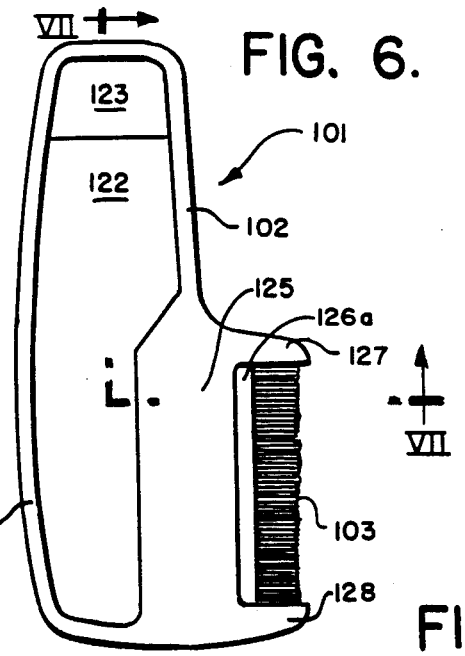
FIG. 6 is a top view of another embodiment of the comb according to the present invention.
Figure 7:
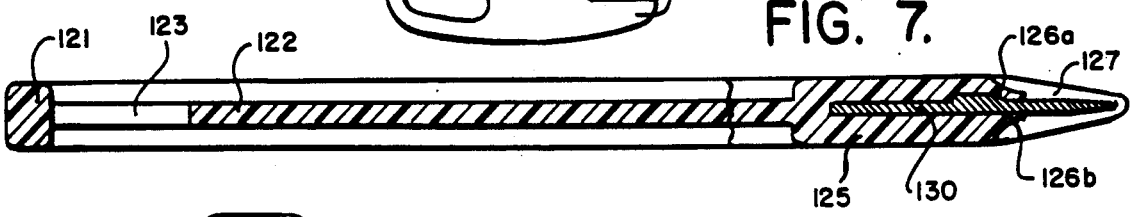
FIG. 7 is a sectional view along the line VII—VII of FIG. 6.
Figure 8:
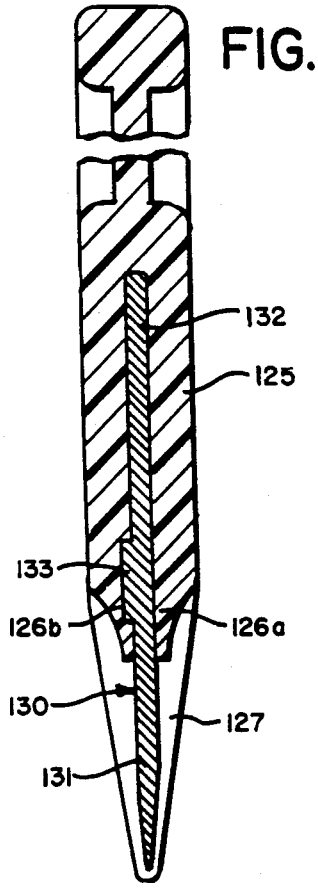
FIG. 8 is a detail of the sectional view of FIG. 7.

FIGS. 3–5 illustrate in more detail the means 3 forming the teeth of the comb. More specifically, the teeth are formed by a plurality of metal tooth members 30 each having a tine portion 31 and a mounting portion 32. In their preferred embodiment according to the present invention, the two portions 31 and 32 are integral with each other and are preferably composed of stainless steel with tines 31 having a polished smooth surface.

Each tooth member 30 has a projection 33 for maintaining the tooth members in place in the handle as will be explained hereinafter.

The tooth members 30 are interconnected in this embodiment by a mechanical linking means including a channel 34 formed in each tooth member 30 at the mounting portion thereof and having inwardly tapering wall portions. The tooth members are mechanically linked by a substantially planar locking member 35. This locking member is made from a spring material and has a bending line 36 running longitudinally at the center thereof. The locking member 35 is flexed around the bending line 36 and inserted into the channels 34 of each of the tooth members 30.

The tooth members 30 are then positioned relative to each other, as shown in FIG. 5, with the preferable spacing at the top of the tine portions 31 of 100 microns. The interlocked tooth members 30 are then inserted into the handle for fixed mounting therein. In the preferred embodiment the handle is molded around the tooth members with the handle embedding the entire mounting portion so that only the tine portion 31 of each tooth member projects from the handle as shown. The tine portions are configured so that over a substantial extent of the length thereof, preferably 70%, the range of clearance between adjacent teeth is from 100 to 120 microns. Preferably there are 20 teeth per 10 mm along the extent of the handle and the teeth have a thickness of approximately 0.4 mm.

In the embodiment shown, the tine portions 31 of the teeth members 30 have an arcuate cross-section forming a concave nit trap 37 on one side thereof. This nit trap 37 in conjunction with the reduced thickness portion 26 of the end portion 25 of the comb handle serves as a repository for the nits as they are removed during combing. Furthermore, the end portion 25 of the comb handle 2 includes teeth guard members 27, 28 which extend beyond the dimensions of the teeth of the comb and serve to protect the comb teeth from unnecessary damage.

In the embodiment shown, the tooth members 30 have an approximate overall length of ½" with the tine portion extending approximately 3/16" in length.

In the embodiment shown in FIGS. 6–9, the comb 101 includes the handle 102 and means 103 forming the metal teeth. The handle 102, which is preferably made of rigid plastic, includes the relative thick peripherial ribbed portion 121 which is preferably 3/16" in thickness and which surrounds the reduced thickness central portion 122 having the gripping aperture 123 therein. The handle 102 also has the tooth mounting portion 125 having a thickness equal to that of the ribbed portion 121 and having the reduced thickness portions **126*a*, 126*b* at either side thereof forming a trough with respect to the teeth forming means 130 for capturing nits. The handle 102 also has the teeth guard members 127, 128 as in the embodiment of FIGS. 1–3**.

Figure 9:
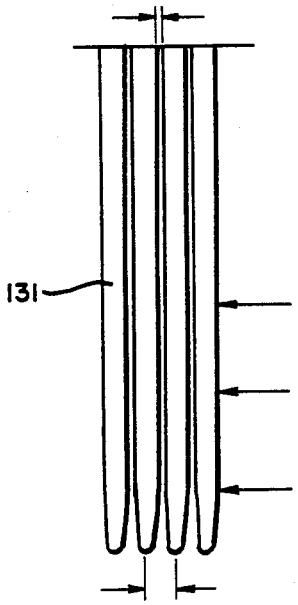
FIG. 9 is a detail of the teeth according to the embodiment of FIG. 6.

In this embodiment, the tooth members 130 are elongated straight members having the tine portion 131 and the mounting portion 132 thereof. The tooth forming members are preferably assembled, according to the method of the present invention by mechanical bonding such as epoxy resin or soldering with the spacing therebetween as shown in FIG. 9. This spacing includes the minimum spacing of 100 microns at the top of the tine portions 131 which then increases to 110 microns at the middle thereof and further increasing to 120 microns at the 70% point. Thereafter the tine portions taper even further to enable the hair to be easily received therein during use. While the tine portions 131 are relatively longer than the tine portions of the first embodiment, that is, approximately 11/32", the intertooth spacing and the number of teeth per mm is the same as in the first embodiment. The tooth members 130 also include a mounting projection 133. When the interconnected tooth members 130 are to be fixed in the handle 102, this is carried out by preferably molding the handle about the mounting portions of the tooth members 130 to completely embed same leaving only the tine portions 131 exposed. Thus the end of handle portions **126*a*, 126*b* extend only up to the point where the clearance between the adjacent teeth is 100 microns. The projections 133** prevent the inadvertent removal of the interconnected teeth from the comb.

It will be appreciated that the instant specification and drawings are set forth by way of illustration and not limitation and that various modifications and changes may be made without departing from the spirit and the scope of the present invention. For example, the handles can be made from various moldable materials including metal and diverse types of plastic. Additionally the interconnection of the individual integral tooth members can be carried out by other conventional techniques and utilizing other adhesives not specifically mentioned herein.

What is claimed is:

1. A comb for removing nits comprising: a handle; and means forming a plurality of elongated metal teeth comprising a plurality of discrete elongated metal tooth members, each having a mounting portion and a tine portion extending therefrom, wherein each metal tooth member is configured when disposed side by side with another metal tooth member to form an intertooth clearance between adjacent tine portions which tapers down to a minimum of about 100μ and wherein the tine portions have a substantial longitudinal extent wherein the intertooth clearance tapers from about 120μ to about 100μ, and means fixedly interconnecting the tooth members side-by-side comprising an elongated channel in each mounting portion of the tooth and an elongated interconnecting member configured to be tightly received in each elongated channel to align same side-by-side with the aforesaid clearance; and means mounting the teeth in the handle with only the tine portion projecting therefrom.

2. A method of producing a comb for removing nits comprising: forming a plurality of metal teeth by providing a plurality of discrete metal tooth members, each having a mounting portion and a tine portion extending therefrom, configuring each metal tooth member when disposed side by side with another metal tooth member to form an intertooth clearance between adjacent tine portions which tapers down to a minimum of about 100μ and wherein the tine portions have a substantial longitudinal extent wherein the intertooth clearance tapers from about 120μ to about 100μ fixedly interconnecting the tooth members side-by-side by providing an elongated channel in each mounting portion of the tooth and inserting an elongated interconnecting member in each elongated channel to align same side-by-side with the aforesaid clearance and mounting the teeth in the handle with only the tine portion projecting therefrom.

* * * * *